US010181671B2

(12) United States Patent
Ma

(10) Patent No.: US 10,181,671 B2
(45) Date of Patent: Jan. 15, 2019

(54) OPENING/CLOSING PLUG DEVICE

(71) Applicant: Cord-It Limited, Kowloon, Hong Kong (CN)

(72) Inventor: Hing Wai Michael Ma, Hong Kong (CN)

(73) Assignee: Cord-It Limited, Kowloon, Hong Kong (CN)

( * ) Notice: Subject to any disclaimer, the term of this patent is extended or adjusted under 35 U.S.C. 154(b) by 0 days.

(21) Appl. No.: 15/517,308

(22) PCT Filed: Oct. 8, 2015

(86) PCT No.: PCT/CN2015/091493

§ 371 (c)(1),
(2) Date: Jul. 17, 2017

(87) PCT Pub. No.: WO2016/055010

PCT Pub. Date: Apr. 14, 2016

(65) Prior Publication Data

US 2017/0338580 A1 Nov. 23, 2017

(30) Foreign Application Priority Data

Oct. 7, 2014 (HK) ..... 14109991

(51) Int. Cl.
*H01R 24/30* (2011.01)
*H01R 27/00* (2006.01)
(Continued)

(52) U.S. Cl.
CPC ..... *H01R 13/44* (2013.01); *H01R 13/502* (2013.01); *H01R 24/30* (2013.01); *H01R 13/688* (2013.01); *H01R 2103/00* (2013.01)

(58) Field of Classification Search
CPC ..... H01R 27/00; H01R 13/652; H01R 35/04; H01R 13/447; H01R 13/688;
(Continued)

(56) References Cited

U.S. PATENT DOCUMENTS 3,958,849 A * 5/1976 Blairsdale ..... H01R 13/652 439/104
4,997,381 A * 3/1991 Oh ..... H01R 27/00 439/131
(Continued)

FOREIGN PATENT DOCUMENTS

CN 101461104 6/2009
CN 101939810 1/2011
(Continued)

*Primary Examiner* — Amy Cohen Johnson
*Assistant Examiner* — Matthew T Dzierzynski
(74) *Attorney, Agent, or Firm* — Alix, Yale & Ristas, LLP

(57) ABSTRACT

A foldable plug device includes a pin module having at least one fixed pin. A first articulating shaft is disposed in a bottom of the pin module, and a first casing and a second casing are disposed at two sides of the pin module. A slot is disposed in a middle portion of the first casing. A movable pin corresponding to the fixed pin is disposed at the second casing, and the movable pin is configured such that the movable pin is located in the slot when the two casings are folded, and the movable pin is turned out of the slot when the two casings are unfolded, to form a plug cooperating with the fixed pins.

18 Claims, 14 Drawing Sheets

(51) Int. Cl.

| | |
|---|---|
| ***H01R 13/652*** | (2006.01) |
| ***H01R 35/04*** | (2006.01) |
| ***H01R 13/44*** | (2006.01) |
| ***H01R 13/502*** | (2006.01) |
| *H01R 103/00* | (2006.01) |
| *H01R 13/688* | (2011.01) |

(58) Field of Classification Search

CPC ..... H01R 13/692; H01R 31/06; H01R 13/42; H01R 13/44; H01R 13/502; H01R 13/506; H01R 13/7132; H01R 24/28; H01R 24/66

USPC ..... 439/131, 172, 103, 174, 104, 518, 640, 439/105

See application file for complete search history.

(56) References Cited

U.S. PATENT DOCUMENTS 5,611,701 A * 3/1997 Hahn ..... H01R 24/66 439/131
5,641,292 A * 6/1997 Fann ..... H01R 13/652 439/103
5,851,123 A * 12/1998 Chou ..... H01R 24/28 439/172
5,967,807 A * 10/1999 Wu ..... H01R 29/00 439/131
6,089,886 A * 7/2000 Mareno ..... H01R 35/04 439/131
6,126,460 A * 10/2000 Wu ..... H01R 27/00 439/131
6,939,150 B1 * 9/2005 Lanni ..... H01R 35/04 439/131
7,604,492 B1 * 10/2009 Wang ..... H01R 24/30 439/131
8,366,461 B2 * 2/2013 Lee ..... H01R 24/30 439/131
8,936,490 B2 * 1/2015 Hsu ..... H01R 35/04 439/103
9,331,441 B2 * 5/2016 Roy ..... H01R 13/434
9,385,549 B2 * 7/2016 Miller ..... H02J 7/0042
9,531,124 B2 * 12/2016 Ohler ..... H01R 13/633
9,716,352 B1 * 7/2017 Gilliland ..... H01R 24/30
9,721,735 B2 * 8/2017 Hsu ..... H01H 13/14
2016/0197561 A1 * 7/2016 Riphin ..... H02M 7/003 363/146

FOREIGN PATENT DOCUMENTS

| | | |
|---|---|---|
| CN | 201774009 | 3/2011 |
| CN | 102439800 | 5/2012 |
| CN | 104393456 | 3/2015 |
| CN | 104409911 | 3/2015 |
| EP | 1240689 | 7/2009 |

* cited by examiner

OPENING/CLOSING PLUG DEVICE

FIELD

The present disclosure relates to a plug device, and more particularly to a portable plug device which is foldable and can be unfolded in use.

BACKGROUND

In the prior art, a plug device, in particular, a plug device with three pins generally has a large volume, resulting in inconvenient store and carry, and the plugs are easy to damage. A foldable plug device is present in the prior art. However, due to its complicated structure, it is hard to unfold and is hard to generalize in the market.

Therefore, the plug device in the prior art presents room for improvement and development.

SUMMARY

An objective of the present disclosure is to provide a foldable plug device, which has a simple structure and is convenient to fold and use.

The technical solution according to the present disclosure is as follows.

A foldable plug device includes a pin module having at least one fixed pin and disposed in an inserting direction. A first articulating shaft is disposed in a bottom of the pin module, and two casings including a first casing and a second casing rotatable about the first articulating shaft are disposed at two sides of the pin module, in which a slot is disposed in a middle portion of the first casing. A movable pin corresponding to the fixed pin is disposed to the second casing, and the movable pin is configured such that the movable pin is located in the slot when the two casings are folded, and the movable pin is turned out of the slot when the two casings are unfolded, to form a plug cooperating with the fixed pin.

According to some embodiments of the present disclosure, a rotatable second articulating shaft is disposed in a bottom of the movable pin. A third articulating shaft is disposed at a predetermined distance from the second articulating shaft, and a pull tab articulated with the third articulating shaft is disposed at an inner sidewall of the second casing. The movable pin is L-shaped, and the second articulating shaft and the third articulating shaft are located in an end of a bottom of the L-shaped movable pin.

According to some embodiments of the present disclosure, the pull tab is connected to the inner sidewall of the second casing through a fourth articulating shaft.

According to some embodiments of the present disclosure, two fixed pins are provided, and the fixed pins and the movable pin are configured as British 13A pins.

According to some embodiments of the present disclosure, an elastic element for unfolding the first casing and the second casing is disposed around the first articulating shaft and between the first casing and the second casing.

According to some embodiments of the present disclosure, the elastic element is configured as a coil spring, and two legs of the elastic element are fixed on the first casing and the second casing, respectively.

According to some embodiments of the present disclosure, a button is disposed on a sidewall of the first casing, and configured to release a snap-fit structure for folding the first casing and the second casing when pressed. The snap-fit structure includes a resilient snap protrusion at a corresponding position of the second casing, and a press portion on a bottom surface of the button and configured to be fitted with the resilient snap protrusion.

According to some embodiments of the present disclosure, the plug device is further provided with a direct current power output circuit and an interface thereof.

According to some embodiments of the present disclosure, the plug device is further provided with a power storage unit and at least one USB power output electrically coupled with the power storage unit.

According to some embodiments of the present disclosure, the plug device is further provided with at least one USB power output.

With the articulation structure between the first casing and the second casing and the slot disposed in the first casing for facilitating the turning of the movable pin, the foldable plug device according to the present disclosure has a smaller plug volume when folded and a simple and durable pin structure when unfolded.

DETAILED DESCRIPTION

The preferred embodiments of the present disclosure are illustrated in detail below.

Figure 1A:
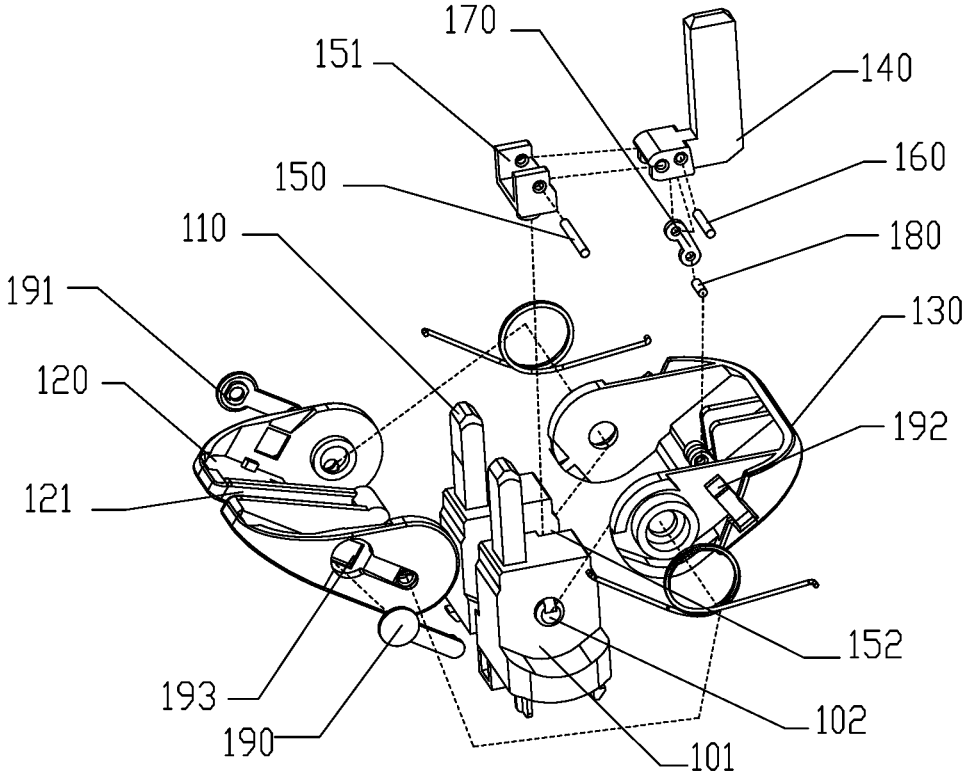
FIGS. 1*a* and 1*b* are exploded views of a plug device according to a first preferred embodiment of the present disclosure.
Figure 1B:
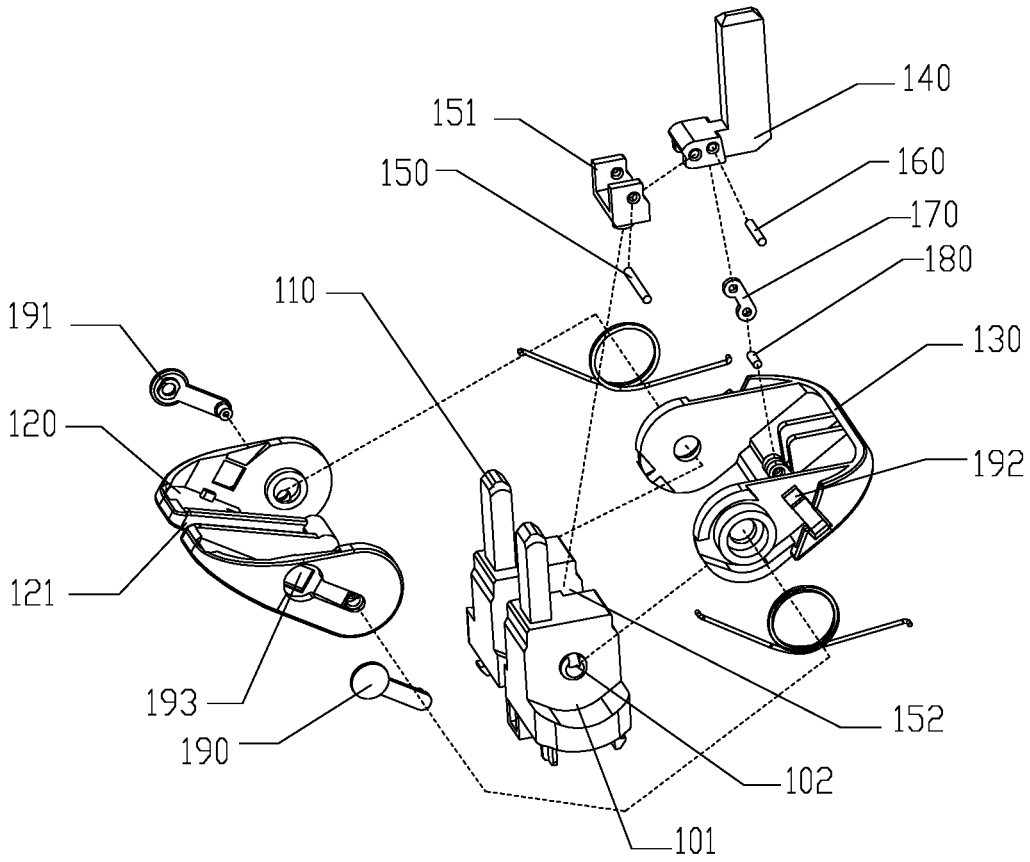

A foldable plug device according to the present disclosure may have various embodiments, as illustrated in the accompanying drawings. As shown in FIGS. 1*a* and 1*b*, the plug device of the present disclosure includes a pin module 101 having at least one fixed pin 110. One or two fixed pins 110 may be provided and configured to be pins of different standards. The plugs according to various embodiments of the present disclosure illustrated in the accompanying drawings are configured as British 13A plugs which conform to Hong Kong standard, and are provided with pins conforming to British Standard, which are suitable for countries adopting the BS standard such as Britain, Singapore, Hong Kong, Malaysia, Middle East and so on. The pin module 101 is fixedly disposed in an inserting direction. A bottom of the pin module is provided with a first articulating shaft 102, and two casings, including a first casing 120 and a second casing 130, which are rotatable about the first articulating shaft and are articulated through the first articulating shaft 102. A slot 121 is disposed in a middle position of the first casing 120, and the slot 121 is arranged at a place where a movable pin can be conveniently turned. The movable pin 140 is configured to adopt a turnable structure, such that the movable pin 140 is located in the slot 121 when the two casings 120, 130 are in a folded state, and the movable pin 140 is turned out of the slot 121 when the two casings are in an unfolded state to form a plug cooperating with the fixed pin 110.

Therefore, the pin structure can be conveniently turned, and the two casings may be folded in idle, such that the volume thereof is reduced, and it is convenient to carry. The two casings may be unfolded in use, such that the movable pin may be turned and extend out to form an available plug structure.

Figure 5A:
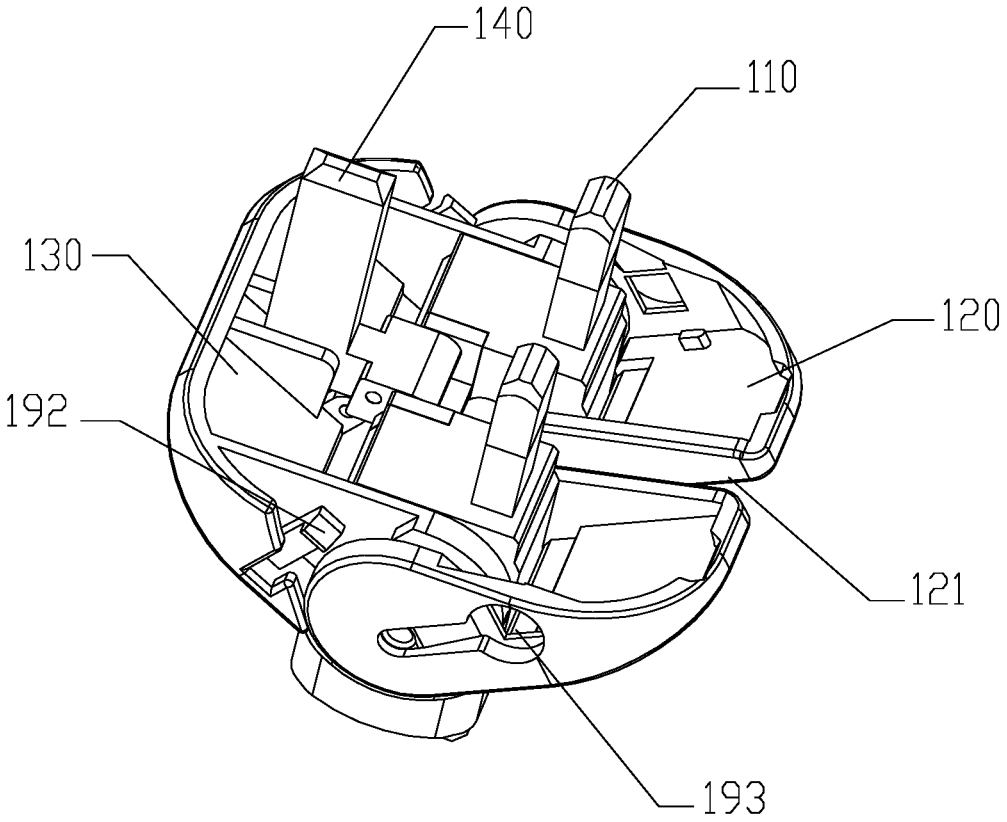
FIGS. 5*a* and 5*b* are perspective views of the plug device from different angles according to the first preferred embodiment of the present disclosure, in which the plug device is unfolded.
Figure 5B:
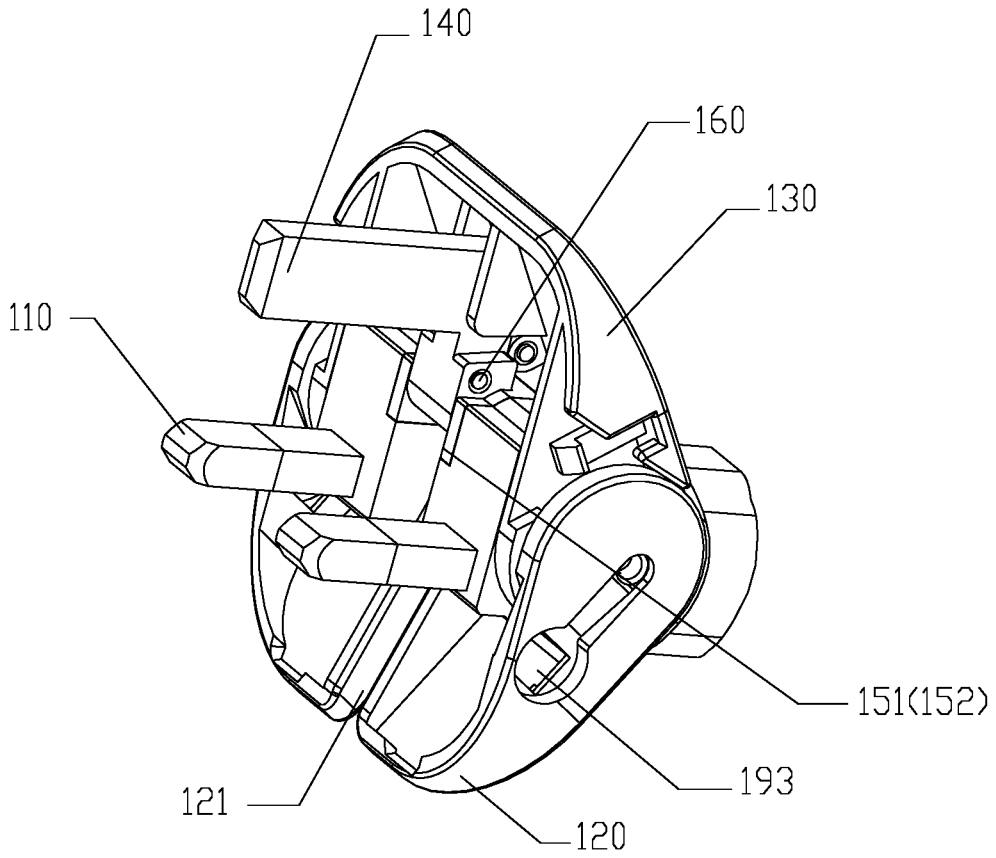

More specially, in the structure of the plug device according to the preferred embodiment of the present disclosure, as shown in FIGS. 1*a*, 1*b*, 3*a* and 3*b*, a second articulating shaft 150 capable of allowing the rotation of the movable pin 140 is disposed in a bottom of the movable pin 140, and the second articulating shaft 150 is fixed on a lower side of the pin module 101 through an articulation shaft fixing part 151. When the pin module 101 is provided with two fixed pins, a groove 152 for fixing the articulation shaft fixing part 151 may be provided between the two fixed pins (the articulation shaft fixing part 151 and the groove 152 are only illustrated in FIGS. 1*a* and 1*b*), and with reference to FIG. 5*b* at the same time. A third articulating shaft 160 is disposed in the movable pin 140 at a predetermined distance from the position of the second articulating shaft 150, and a pull tab 170 is also provided. The pull tab 170 has a first end articulated with a fourth articulating shaft 180 in an inner sidewall of the second casing, and a second end articulated with the second articulating shaft 160.

Figure 2A:
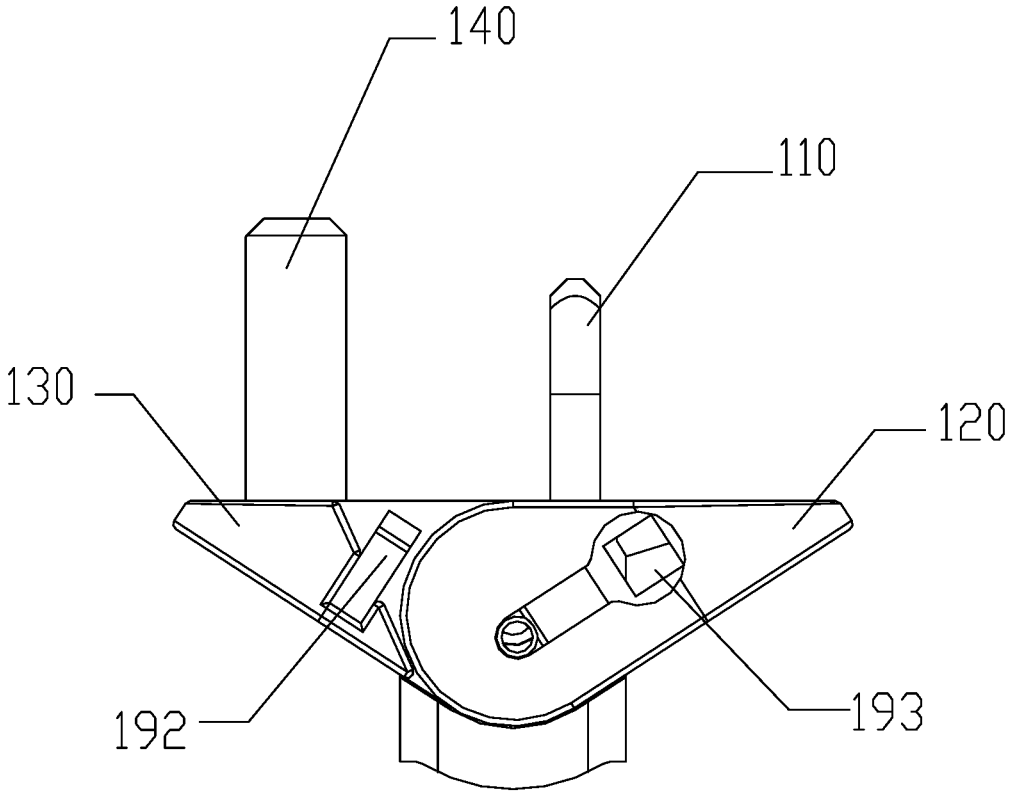
FIGS. 2*a* and 2*b* are schematic views of the plug device according to the first preferred embodiment of the present disclosure.
Figure 6:
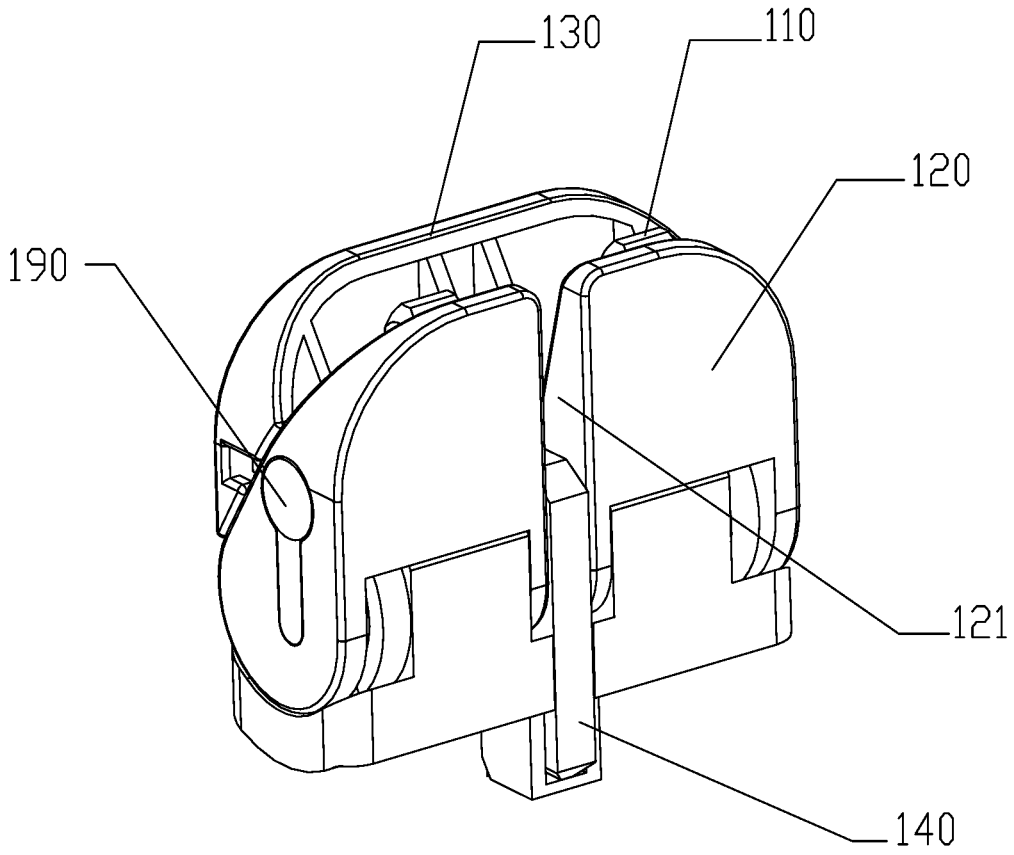
FIG. 6 is a perspective view of the plug device according to the first preferred embodiment of the present disclosure, in which the plug device is folded.

Thus, when the two casings 120, 130 are unfolded, the second casing 130 drives the movable pin 140 to turn. The movable pin 140 itself is configured to be L-shaped. The second articulating shaft 150 and the third articulating shaft 160 are both disposed in an end of the bottom of the L-shaped movable pin 140. The end of the movable pin 140 is turned downward and received into the slot 121, as shown in FIG. 3*b* (FIGS. 3*a* and 3*b* are perspective views, which cannot be really seen). Accordingly, when the two casings 120, 130 are unfolded towards two sides, the second casing drives the movable pin 140 to turn about the second articulating shaft 150 thereof through the pull tab 170 and the third articulating shaft 160, such that the movable pin 140 may be easily turned. When an elastic force is added, the structure may be unfolded automatically. The unfolded state of the plug device of the present disclosure is shown in FIGS. 2*a*, 4, 5*a* and 5*b*, and the folded state thereof is shown in FIGS. 2*b* and 6.

According to an embodiment of the present disclosure, an elastic element 180 around the first articulating shaft 102 is further disposed between the first casing 120 and the second casing 130, and an elastic restoring force of the elastic element 180 is used to unfold the first casing 120 and the second casing 130. Specifically but not limited, the elastic element 180 is configured as a coil spring, and two elastic elements 180 are provided and located at two sides of the first articulating shaft and between the first casing 120 and the second casing 130, and two legs of each elastic element 180 are fixed on the first casing 120 and the second casing 130 respectively, to drive the two casings to be unfolded. The two casings may be unfolded automatically and the movable pin may be turned out due to the provision of the structures of the elastic element 180 and the above pull tab 170, such that an available plug state is formed.

Figure 2B:
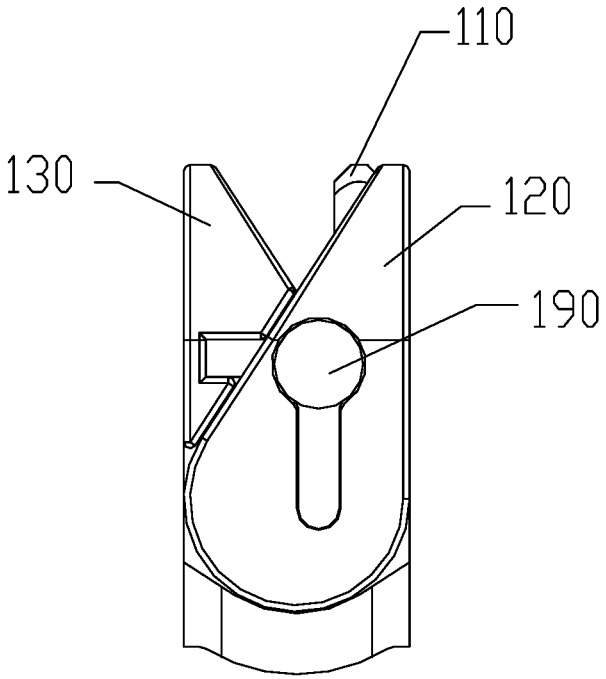
Figure 3A:
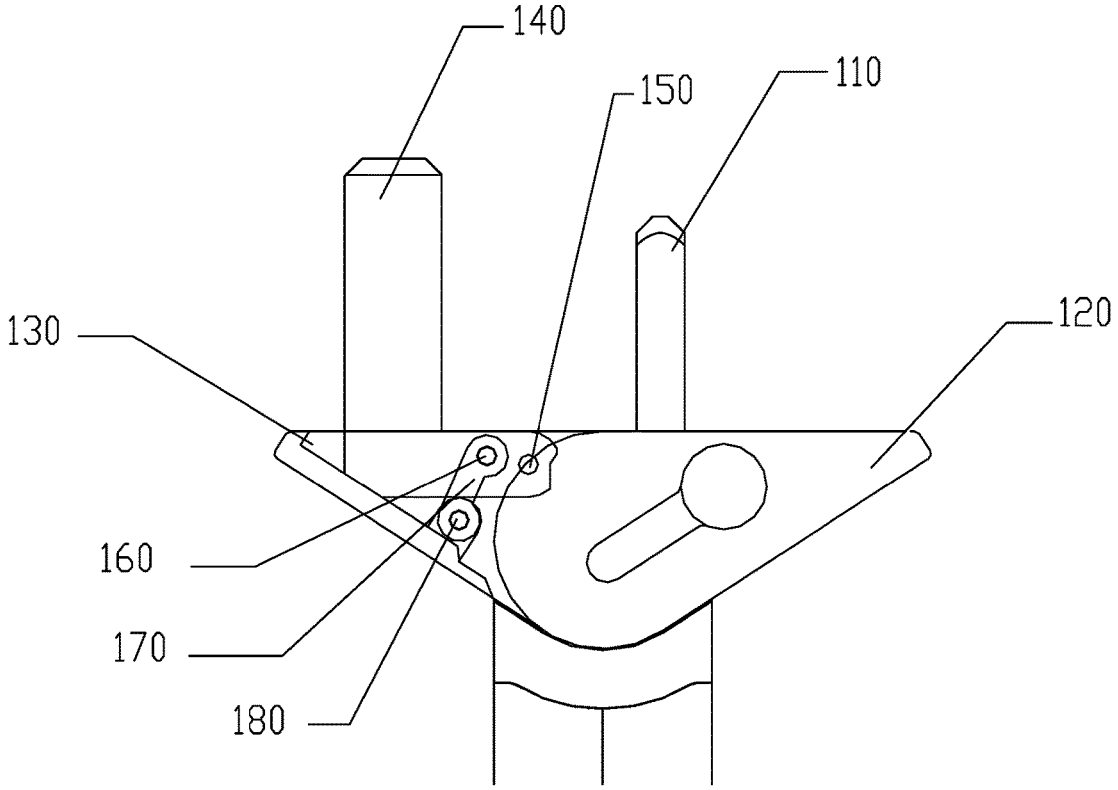
FIGS. 3*a* and 3*b* are perspective views of the plug device according to the first preferred embodiment of the present disclosure.
Figure 3B:
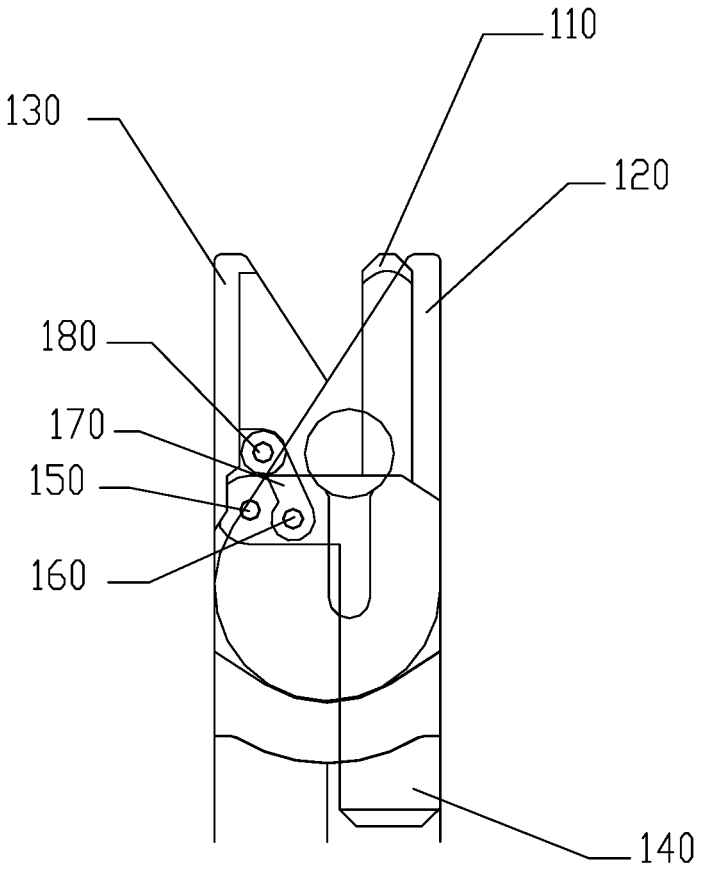
Figure 4:
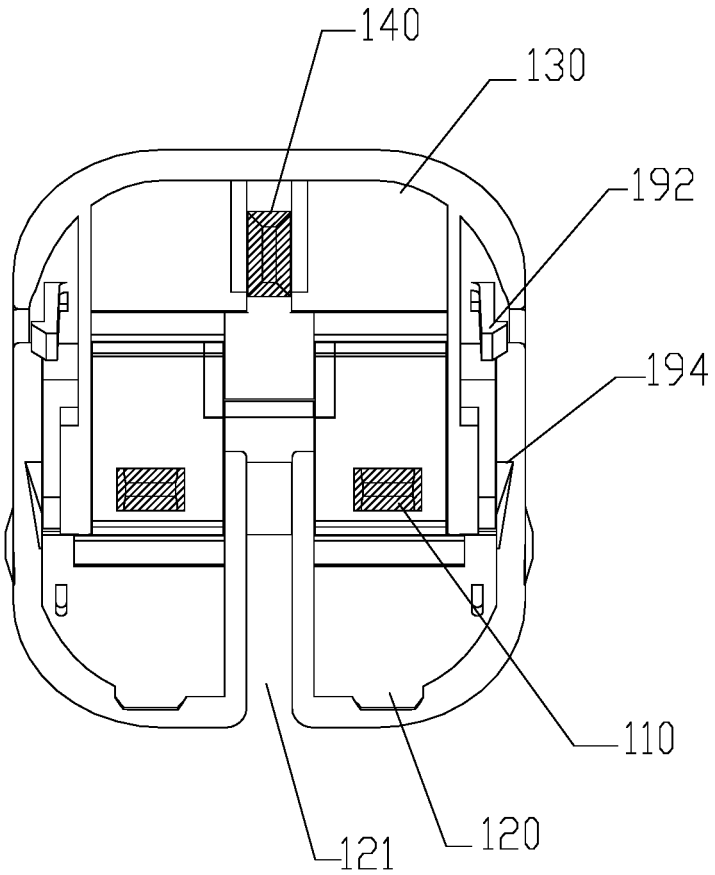
FIG. 4 is a front view of the plug device according to the first preferred embodiment of the present disclosure, in which the plug device is unfolded.

In order to control the first casing 120 and the second casing 130 to switch from the folded state to the unfolded state, a button 190 is disposed on an sidewall of the first casing 120, as shown in FIGS. 1*a*, 1*b* and 2*b*. Preferably, two buttons 190 are provided at two sides respectively. A press portion 191 is disposed at a bottom surface of the button 190, and a resilient snap protrusion 192 fitted with the press portion 191 is disposed at a corresponding position of the second casing 120. A window 193 is disposed in the first casing 120, as shown in FIG. 2*a*, such that the press portion 191 may enter the window 193 and may be fitted with the resilient snap protrusion 192. The resilient snap protrusion 192 in an initial state protrudes under the action of resilience and extends to a snap step 194 in the window 193, as shown in FIG. 4, in which case the first casing 120 and the second casing 130 are fitted with each other, i.e. in the folded state. When the button 190 is pressed, the press portion 191 presses the resilient snap protrusion 192, such that the resilient snap protrusion 192 departs and retracts from the snap step 194 in the window 193, and the two casings may be freely and relatively smoothly rotated and unfolded.

Accordingly, in the preferred embodiment of the plug device according to the present disclosure, under cooperation of structures such as the button 190, the elastic element 180 and the pull tab 170 and so on, when the elastic element 180 has sufficient elastic restoring force, the plug device according to the present disclosure may automatically achieve the unfolded state under the action of the sufficient elastic restoring force of the elastic element 180 after the button 190 is pressed. The practical effect thereof is amazing, and the whole plug device may be unfolded by only one hand.

In the preferred embodiment of the plug device according to the present disclosure, on a fuse there is room for improvement. According to requirements of ordinances in certain areas, such as Hong Kong, the fuse cannot be removed or put in during use. Therefore, a fuse of a plug and a socket is generally disposed on an inserting surface to comply with the requirements of ordinances. The plug device according to the present disclosure has a small volume after being folded, and an inserting surface is variable. Therefore, an assembly chamber 201 for the fuse 201 is disposed below the first casing or the second casing, and a cover 203 may be obstructed by the corresponding casing, as shown in FIGS. 7*a*, 7*b*, 8*a*, and 8*b*. After that the corresponding casing is unfolded, the cover of the assembly chamber for the fuse is obstructed by the casing and is unable to be opened, so as to satisfy the requirement that the fuse cannot be replaced during use.

Figure 7A:
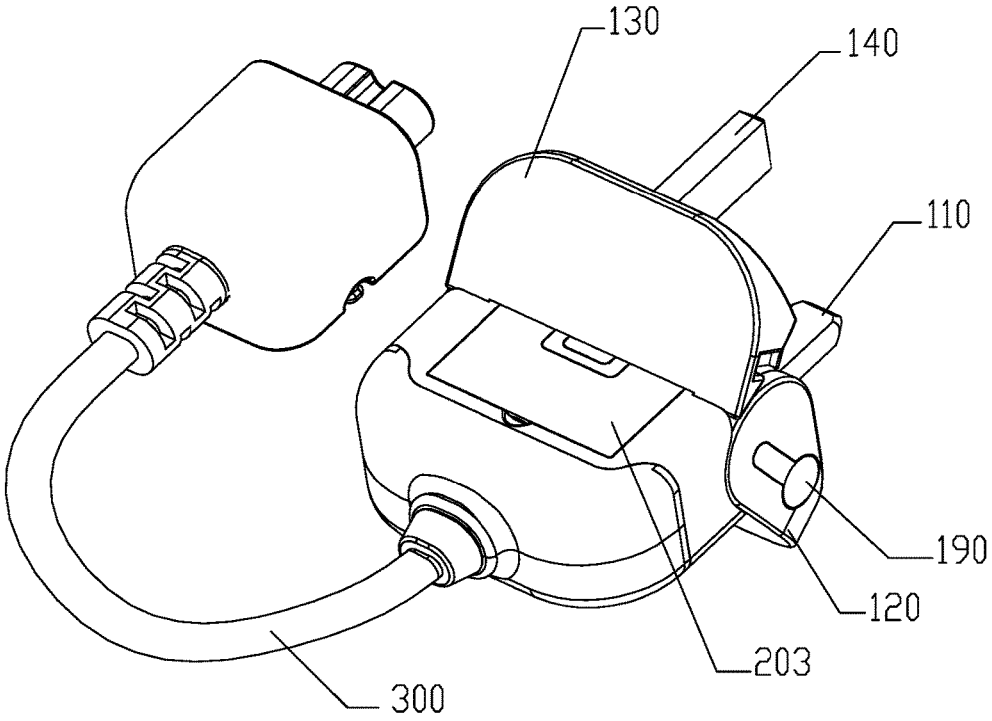
FIGS. 7*a* and 7*b* are schematic views of a plug device according to a second preferred embodiment of the present disclosure.
Figure 7B:
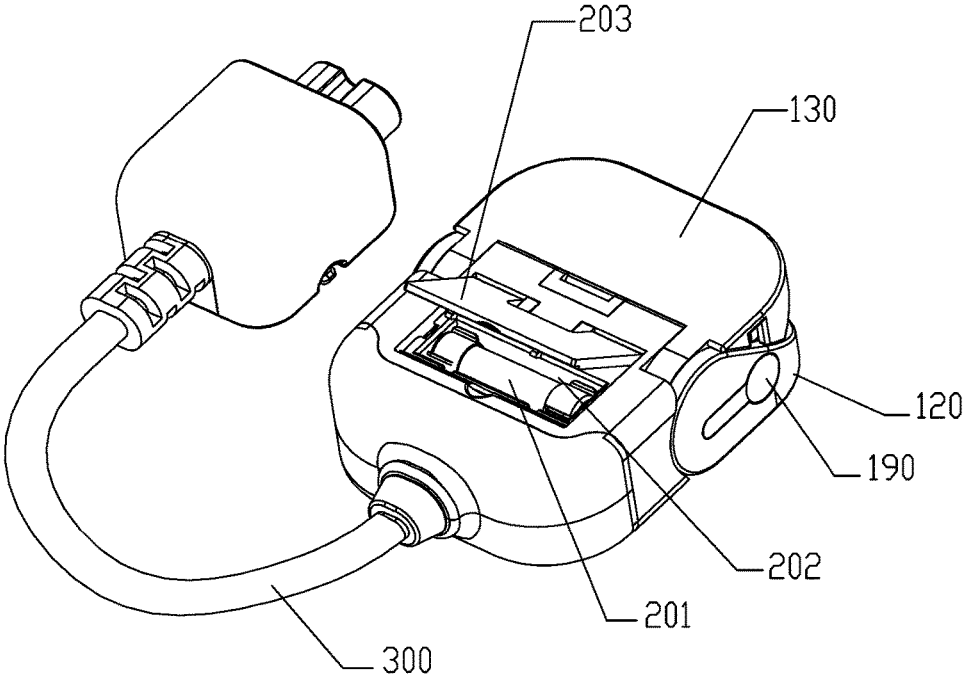
Figure 7C:
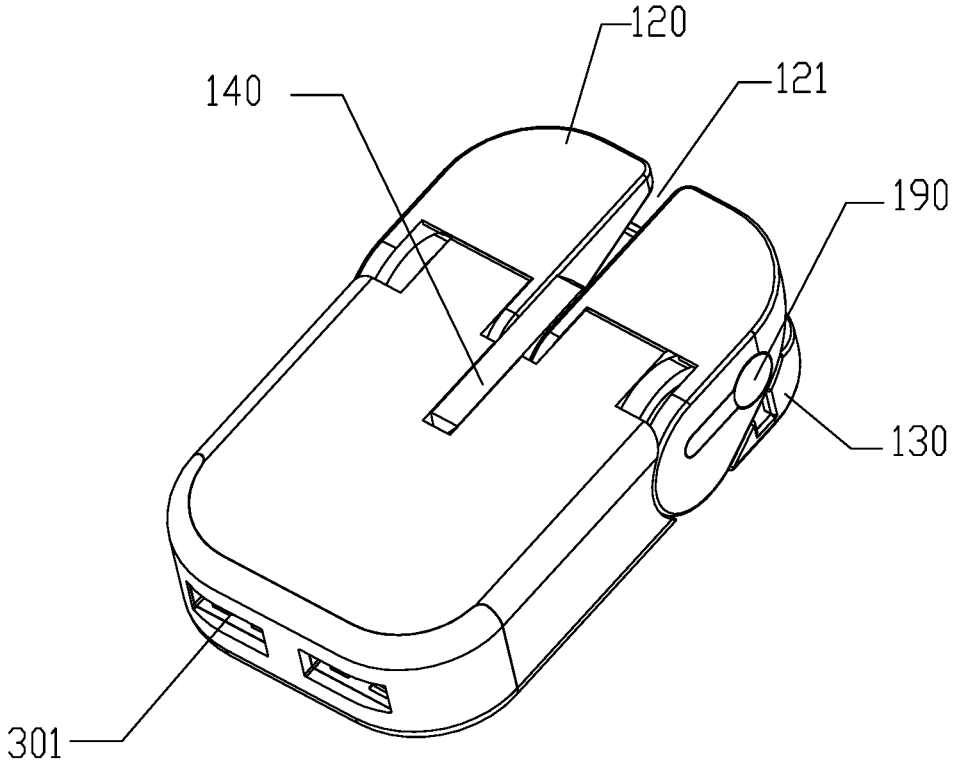
FIG. 7*c* is a schematic view of a plug device according to a third preferred embodiment of the present disclosure.

Another embodiment of the preferred embodiments of the plug device according to the present disclosure may refer to FIGS. 7*a* and 7*b*, a power output cable 300 and a plug of other corresponding type are connected to a rear end of the plug device of the illustrated embodiment. FIG. 7*c* shows another embodiment derived from the embodiment shown in FIG. 7*a* wherein a USB power output 301 is disposed in the rear end thereof.

Figure 8A:
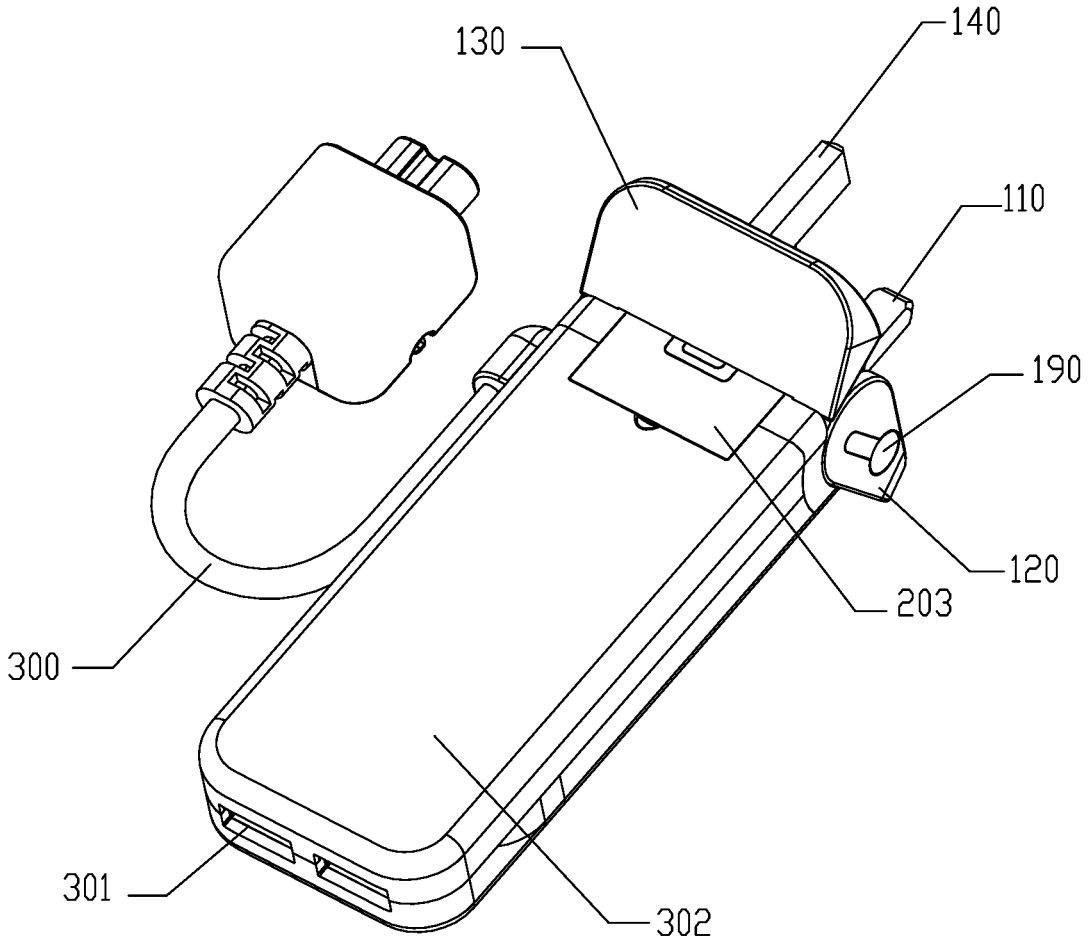
FIGS. 8*a* and 8*b* are schematic views of a plug device according to a fourth preferred embodiment of the present disclosure.
Figure 8B:
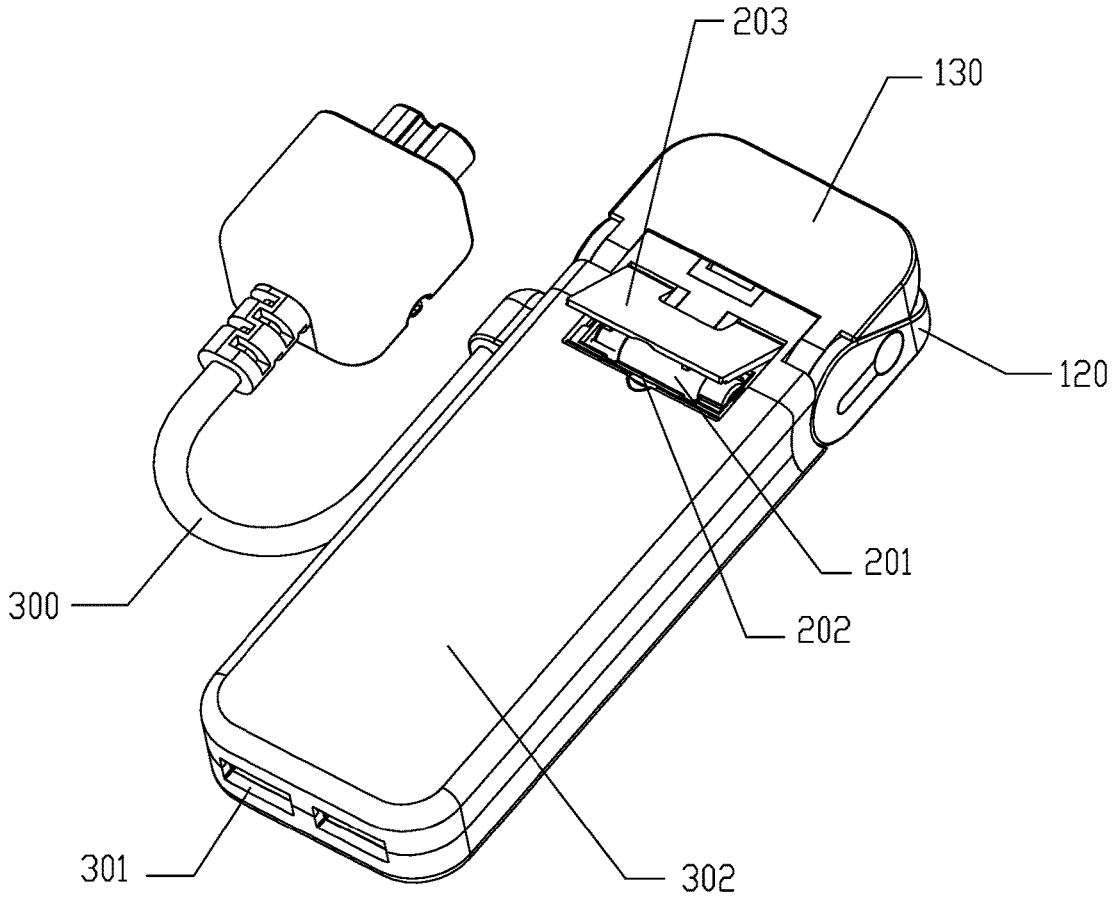
Figure 8C:
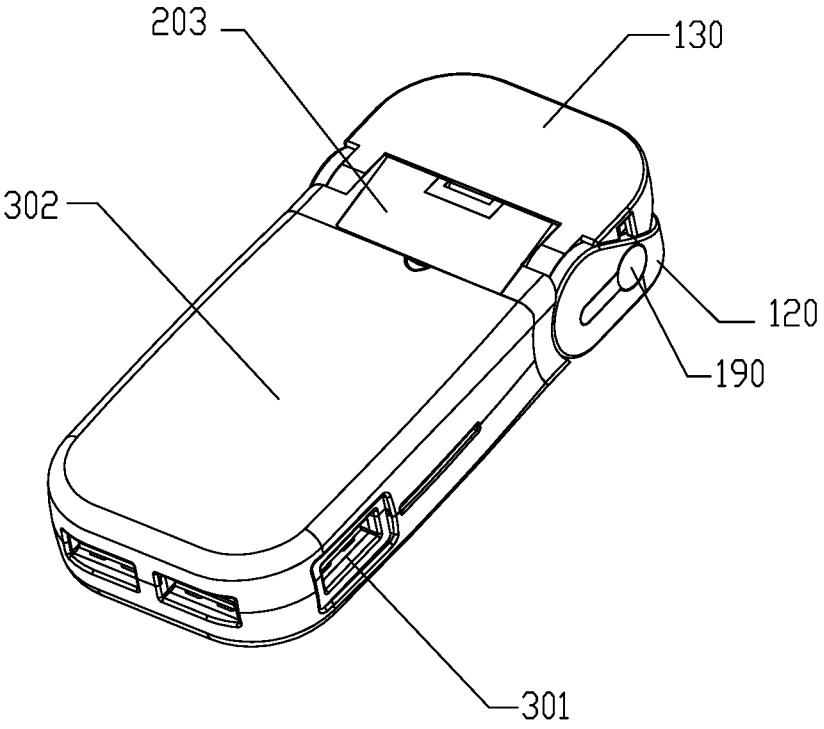
FIG. 8*c* is a schematic view of a plug device according to a fifth preferred embodiment of the present disclosure.

As shown in FIGS. 8*a* and 8*b*, in the plug device according to the preferred embodiment of the present disclosure, an accommodating portion 302 for a mobile power supply is disposed in the rear end of the plug device, and two USB power outputs 301 may also be disposed in a bottom thereof. As to the plug device shown in FIG. 8*c*, three USB power outputs are provided, in addition to the two disposed in the bottom end, the other one is further disposed in a side. Certainly, when the USB power output is adopted in the respective preferred embodiment according to the present disclosure, a management and control circuit also needs to be provided, which is well known by those skilled in the art, and will not described in detail herein. The plug device according to the present disclosure may further be provided with a direct current power output circuit and a corresponding interface, or may also be provided with at least one USB power output for outputting the direct current power.

It should be understood that, improvements and changes can be carried out by those skilled in the art, and all the improvements and changes are intended to be within the scope of the accompanying claims of the present disclosure.

The invention claimed is:

1. A foldable plug device comprising:

a pin module having at least one fixed pin and disposed in an inserting direction;

a first articulating shaft disposed in a bottom of the pin module; and two casings, comprising a first casing and a second casing, rotatable about the first articulating shaft, and disposed at two sides of the pin module, wherein a slot is disposed in a middle portion of the first casing, a movable pin corresponding to the fixed pin is disposed in the second casing, and the movable pin is configured such that the movable pin is located in the slot when the two casings are folded, and the movable pin is turned out of the slot when the two casings are unfolded, to form a plug cooperating with the fixed pin; and wherein a rotatable second articulating shaft is disposed in a bottom of the movable pin, a third articulating shaft is disposed at a predetermined distance from the second articulating shaft, and a pull tab articulated with the third articulating shaft is disposed on an inner sidewall of the second casing; the movable pin is L-shaped, and the second articulating shaft and the third articulating shaft are located in an end of a bottom of the L-shaped movable pin.

2. The foldable plug device according to claim 1, wherein the pull tab is connected to the inner sidewall of the second casing through a fourth articulating shaft.

3. The foldable plug device according to claim 2, wherein two fixed pins are provided, and the fixed pins and the movable pin are configured as British 13A pins.

4. The foldable plug device according to claim 3, wherein an elastic element for unfolding the first casing and the second casing is disposed around the first articulating shaft and between the first casing and the second casing.

5. The foldable plug device according to claim 3, wherein the plug device is further provided with a direct current power output circuit and an interface thereof.

6. The foldable plug device according to claim 3, wherein the plug device is further provided with a power storage unit and at least one USB power output electrically coupled with the power storage unit.

7. The foldable plug device according to claim 2, wherein an elastic element for unfolding the first casing and the second casing is disposed around the first articulating shaft and between the first casing and the second casing.

8. The foldable plug device according to claim 2, wherein the plug device is further provided with a direct current power output circuit and an interface thereof.

9. The foldable plug device according to claim 2, wherein the plug device is further provided with a power storage unit and at least one USB power output electrically coupled with the power storage unit.

10. The foldable plug device according to claim 1, wherein an elastic element for unfolding the first casing and the second casing is disposed around the first articulating shaft and between the first casing and the second casing.

11. The foldable plug device according to claim 10, wherein the elastic element is configured as a coil spring, and two legs of the elastic element are fixed on the first casing and the second casing respectively.

12. The foldable plug device according to claim 11, wherein a button is disposed on a sidewall of the first casing, and configured to release a snap-fit structure for folding the first casing and the second casing when pressed; the snap-fit structure includes a resilient snap protrusion at a corresponding position of the second casing, and a press portion on a bottom surface of the button and configured to be fitted with the resilient snap protrusion.

13. The foldable plug device according to claim 10, wherein the plug device is further provided with a direct current power output circuit and an interface thereof.

14. The foldable plug device according to claim 1, wherein the plug device is further provided with a direct current power output circuit and an interface thereof.

15. The foldable plug device according to claim 1, wherein the plug device is further provided with a power storage unit and at least one USB power output electrically coupled with the power storage unit.

16. The foldable plug device of claim 15, wherein an elastic element for unfolding the first casing and the second casing is disposed around the first articulating shaft and between the first casing and the second casing.

17. The foldable plug device of claim 15, wherein the plug device is further provided with a direct current power output circuit and an interface thereof.

18. The foldable plug device according to claim 1, wherein the plug device is further provided with at least one USB power output.

* * * * *